United States Patent [19]

Loudon

[11] Patent Number: 5,011,184

[45] Date of Patent: Apr. 30, 1991

[54] STABILIZER SYSTEM

[76] Inventor: Robert W. Loudon, 26011 N. Fairfield Rd., Lake Zurich, Ill. 60042

[21] Appl. No.: 413,781

[22] Filed: Sep. 28, 1989

[51] Int. Cl.[5] ..... B60S 9/12

[52] U.S. Cl. ..... 280/766.1; 254/423; 414/718

[58] Field of Search ..... 280/766.1, 765.1; 212/189; 414/718; 254/419, 423

[56] References Cited

U.S. PATENT DOCUMENTS

| | | | |
|---|---|---|---|
| 2,709,086 | 5/1955 | Magee et al. | 280/423 |
| 2,713,402 | 7/1955 | Balogh | 189/14 |
| 3,106,410 | 10/1963 | Walter | 280/766.1 |
| 3,436,095 | 4/1969 | Preston | 280/766.1 |
| 3,454,251 | 7/1969 | Dye | 280/765.1 |
| 3,627,352 | 12/1971 | Canole | 280/475 |
| 3,881,746 | 5/1975 | Newcomb, Jr. | 280/766.1 |
| 3,885,813 | 5/1975 | Kern | 280/766.1 |
| 3,904,224 | 9/1975 | Belke | 280/766.1 |
| 4,007,847 | 2/1977 | Marco | 280/766.1 |
| 4,124,225 | 11/1978 | Lozada et al. | 280/766.1 |
| 4,245,855 | 1/1981 | Larson | 280/765.1 |
| 4,466,637 | 8/1984 | Nelson | 414/495 |
| 4,583,766 | 4/1986 | Halstensgaard | 280/766.1 |
| 4,743,059 | 5/1988 | Lequeu | 280/766.1 |
| 4,921,392 | 5/1990 | Wagner | 280/766.1 |

FOREIGN PATENT DOCUMENTS

| | | | |
|---|---|---|---|
| 1224161 | 9/1966 | Fed. Rep. of Germany | 280/766.1 |

*Primary Examiner*—David M. Mitchell

*Attorney, Agent, or Firm*—Lockwood, Alex, FitzGibbon & Cummings

[57] ABSTRACT

A stabilizer system for a utility vehicle that includes a stabilizer unit having a hydraulically-actuated piston cylinder, a leg connected to an end of the piston and carried within a protective sleeve, a ground engaging pad, and a hydraulic actuating and control means by which the leg and pad may be extended and retracted within the dimensional profile of the vehicle. In the retracted position, the leg and pad are carried above the undercarriage clearance space of the vehicle. Advantageously, a utility vehicle equipped with the system may be moved into and operated stably in terrain providing limited sidewall and undercarriage clearance space and having highly hetereogeneous and non-supportive soil conditions.

20 Claims, 2 Drawing Sheets

STABILIZER SYSTEM

BACKGROUND AND DESCRIPTION OF THE INVENTION

The present invention generally relates to a stabilizer system. More particularly, the invention relates to a hydraulically-actuated stabilizing system which may be carried on a vehicle without increasing the amount of clearance space required to operate the vehicle. Advantageously, a vehicle equipped with the new stabilizer system may function stably in terrain having highly hetereogeneous and non-supportive soil conditions and limited space.

Utility vehicles, such as wheeled or tracked tractors, earth movers, skid steers, back hoes, and mechanical diggers utilize a variety of tools such as buckets, shovels, and trenchers to perform a variety of tasks at a work site such as shoveling, pushing, trenching, pounding, dumping, breaking, tunneling, and lifting. Under ideal site conditions, these vehicles generally accomplish these tasks with efficiency. However, not all work sites present ideal working conditions. Utility vehicles often must be taken "off-the-road" and maneuvered through and into terrain offering limited sidewall and undercarriage clearance space. The work site itself may present additional factors which would limit the ability of the vehicle to accomplish the given task effectively. Such additional factors include uneven topography and highly hetereogeneous ground conditions including unexpectedly wet or unconsolidated non-supportive surface soils. Under such conditions, the utility vehicle may not be operated stably and, accordingly, to the vehicle's maximum efficiency.

In order to maintain the efficiency at which an utility vehicle may operate at a work site, an apparatus is required which can provide added support for and stabilize the vehicle even under highly varying localized conditions. Yet, the apparatus cannot encumber the vehicle with added weight and clearance problems.

Various mechanisms to support and stabilize utility vehicles are conventionally known. For example, some of such mechanisms consist of arms carried horizontally outward from one or both of the longitudinal or lateral vertical walls of the vehicle. To operate these out-rigger-like stabilizers, their arms must be extended further horizontally outward and vertically downward. Other stabilizing mechanisms include those that are fixed to the undercarriage of the vehicle. These, and other such mechanisms may be manually operated. Those which are hydraulically operable, however, may not include support elements which can be individually actuated.

Conventional stabilizers suffer from a variety of disadvantages. To understand certain of the disadvantages associated with conventional stabilizers, the dimensional profile and undercarriage clearance space of the vehicle must be defined. The dimensional profile of the vehicle is defined as that space around the vehicle which is no farther from the vehicle than the farthest point of the vehicle. To illustrate, the outer limits of the longitudinal portion of the dimensional profile of a wheeled tractor—having wheels, a front hydraulic bucket, and a rear mounted engine—would be defined by the outer portions of the wheels of the vehicle because these portions are generally the farthest points away from the main body of such a vehicle. In this example, the outer limits of the longitudinal portions of the dimensional profile of this vehicle may be defined to be vertical planes which run parallel to, and through the outer portions of the wheels of the vehicle. The front lateral portion of the dimensional profile of the same vehicle would be defined as that space inward from the farthest point of the vehicle extending laterally from the front of the vehicle body. In this example, since this farthest point is the outer portion of the vehicle's front bucket, the front portion of the dimensional profile may be defined to comprise a vertical plane which runs parallel to, and through this point. Similarly, the outer limits of the rear lateral portion of the dimensional profile of the vehicle would be defined, for example, by the rear engine cover of the tractor. From this, it will be appreciated that the dimensional profile of such a vehicle typically is generally rectangular. The undercarriage clearance space is simply that space between the bottom wall of the vehicle, the surface of the ground, and the inner portion, for example, of the wheels of a wheeled tractor.

One of the serious disadvantages of conventional stabilizers and associated with the dimensional profile of the vehicle is that certain known stabilizers function by projecting beyond the profile of the vehicle as unequipped. To illustrate, outrigger-like stabilizers can function only by extending in a horizontal direction outwardly from the walls of the vehicle and beyond the outer portion of the wheels of the vehicle; that is, beyond the dimensional profile of the vehicle. However, the extra space needed to allow such stabilizers to extend outwardly is often limited or non-existent at a work site. This extra space requirement of known stabilizers prevents conventional stabilizers and, thereby, the equipped utility vehicle from being used in areas providing little sidewall clearance.

Other stabilizers, while they may not project beyond the dimensional profile of the vehicle, still may prevent the vehicle from being operated at its optimum effectiveness and efficiency. Such stabilizers are carried vertically beneath the utility vehicle so that they project wholly or in large part, and even when non-operational, into the undercarriage clearance space of the vehicle. Accordingly, a vehicle equipped with these stabilizers has a reduced amount of undercarriage clearance space above the surface of the ground. While the vehicle is being maneuvered into and around a terrain having dense vegetation or highly varied surface conditions, such as one strewn with glacial erratics, the stabilizers may be damaged or completely torn out from under the vehicle's body.

Conventional stabilizer systems suffer from many other more specific disadvantages. For example, most conventional stabilizers are prohibitively heavy, thereby increasing the likelihood that a vehicle equipped with such stabilizers would sink when maneuvered through or operated on non-supportive wet or unconsolidated surface soils. Also, while many conventional stabilizers are permanently affixed to the vehicle, others can be removed only with a great deal of work and by the use of tools that may not be readily available in the field. The efficiency of some stabilizers is also reduced by the fact that they are exclusively actuated by hand and require the vehicle's operator, or a person already outside the cab to engage the mechanism. Other stabilizers that are hydraulically-actuated have, for example, support elements such as legs which cannot be individually controlled. As a result, both legs of the stabilizer system must be actuated even though the stabilizing effect of both legs is not needed. This over-responsiveness to what may be a very localized condition may lead, in fact, to the destabilization of the vehicle. Finally, some stabilizers are designed so that they can only fit outward from the cover to the vehicle's engine. Such stabilizers block access to the engine and require them to be dismantled partially or wholly in order to perform regular maintenance of the vehicle's engine. The amount of cooling air flowing to the engine is also greatly reduced by such placement. Overall, conventional stabilizers decrease the efficiency of, and generally place added weight and/or space limitations on an utility vehicle.

The present invention solves the many problems associated with conventional stabilizers. A vehicle equipped with this new stabilizer system requires no more sidewall or undercarriage clearance space when maneuvering than a vehicle without the stabilizer. Yet, the vehicle is far more useful. A vehicle equipped with this system is able to work in environments inimical to unequipped vehicles.

The present invention provides a stabilizing system that, when retracted, does not add to the amount of horizontal or vertical clearance space required by a vehicle equipped with the system. The present invention includes at least one hydraulically-operated stabilizer unit. In one embodiment, a set of stabilizer units are carried vertically on, and in close conformity to the longitudinal side walls of the utility vehicle. The stabilizer units include legs that, when the system is not in use, may be retracted to a retracted non-ground engaging position and into protective sleeves thereby allowing a vehicle equipped with the system to be maneuvered into and around a work site without the danger that the system may be damaged or torn from the vehicle. When it is necessary to stabilize the vehicle, an operator from within the cab of the vehicle may actuate the system's hydraulic means to lower individually the legs of the system's stabilizer units to an extended ground engaging position. In this position, pads affixed to the ends of the legs rest securely on the ground. Because the stabilizer units may be individually actuated and from within the cab of the vehicle, a vehicle equipped with the present invention may be quickly stabilized in response to very localized soil conditions and topography and without the need for exterior hand labor. Even when fully operational and in the extended position, however, the stabilizer units of the present system do not project beyond the dimensional profile of the vehicle. Accordingly, even when the present system is fully operational, a vehicle equipped with it may be operated in areas offering limited clearance space.

Further advantages of the present invention include the reinforcing elements of the system which prevent deflection, swaying, or other unwanted movement of the system's stabilizer unit. The reinforcing elements, as are the other elements of the present invention, are of relatively light weight construction so that the maneuverability and efficiency of a vehicle equipped with the present invention is not comprised. Furthermore, the present invention includes attachment means which allow the system to be attached or removed from a vehicle quickly and with tools readily available in the field.

An object of the present invention is to provide an unique stabilizer system for a utility vehicle, thereby increasing the vehicle's versatility.

An additional object of the present invention is to provide a stabilizer system which includes at least one stabilizer unit that may be individually actuated.

Another object of the present invention is to provide a vehicle stabilizer system which may be easily attached and removed from a vehicle.

A further object of the invention is to provide a vehicle stabilizer system which may be rigidly secured to a utility vehicle, and reinforced so that the system may withstand the stresses placed on it during operation.

Also, an object of the present invention is to provide a stabilizing system for a utility vehicle which is light in weight so that the maneuverability and efficiency of a vehicle equipped with the system is not comprised.

These, together with other objects and advantages will become subsequently apparent and reside in the details of construction and operation as more fully hereinafter described and claimed, reference being had to the accompanying drawings forming a part hereof, wherein like numerals refer to like parts throughout.

DESCRIPTION OF THE PARTICULAR EMBODIMENTS

Figure 1:
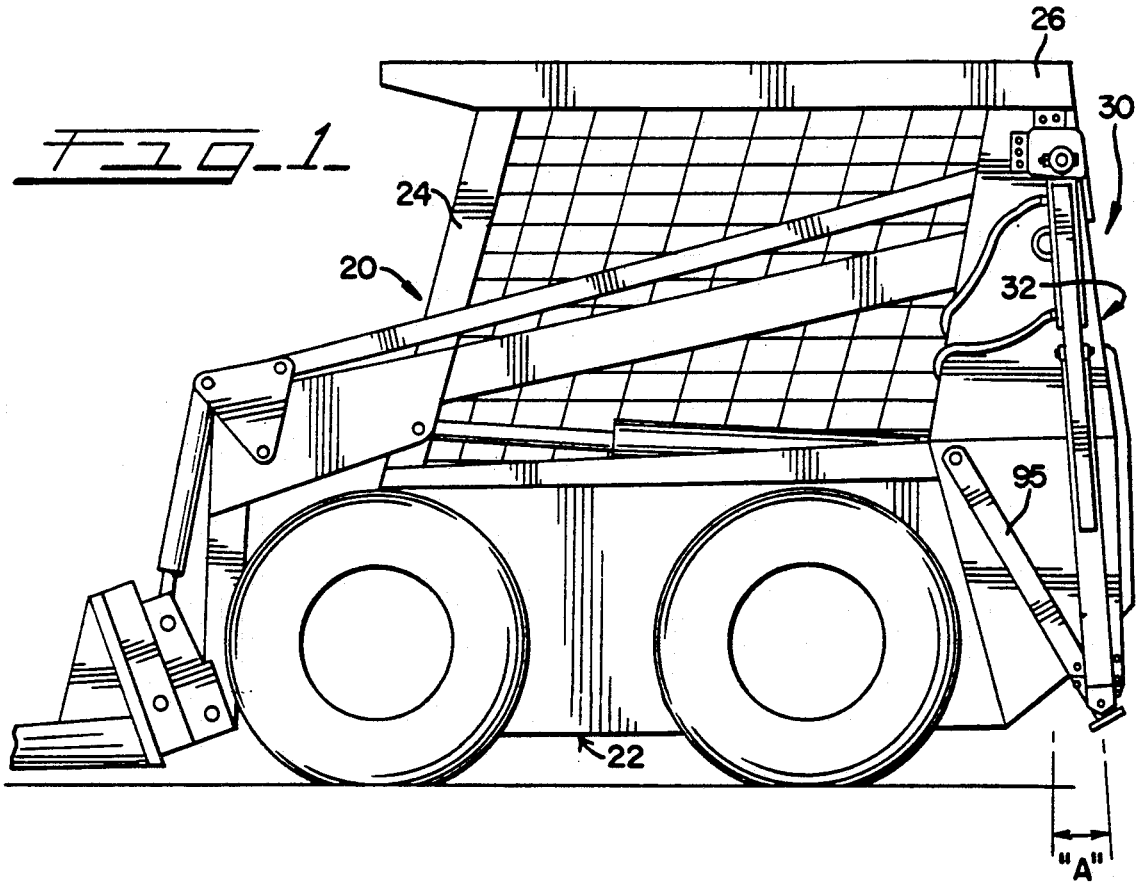
FIG. 1 is a side view of a utility vehicle with one preferred embodiment of the stabilizer system according to the present invention having individual stabilizer units mounted on each longitudinal wall of the vehicle and in its non-operational mode with the legs of the stabilizer units retracted.
Figure 2:
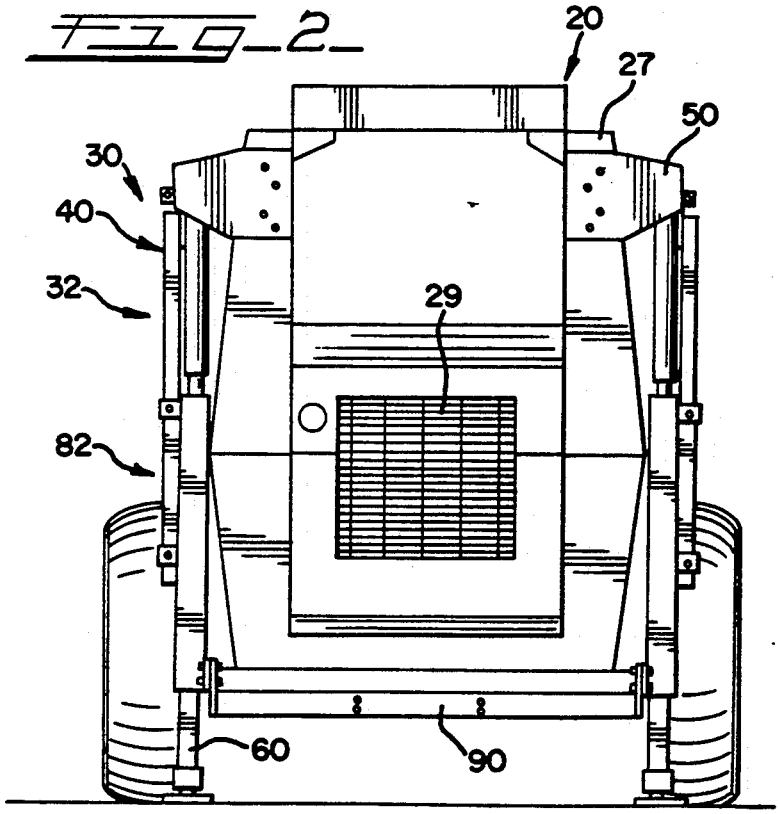
FIG. 2 is a rear view of the vehicle illustrated in FIG. 1 with the legs of the stabilizer units extended to engage the ground.
Figure 3:
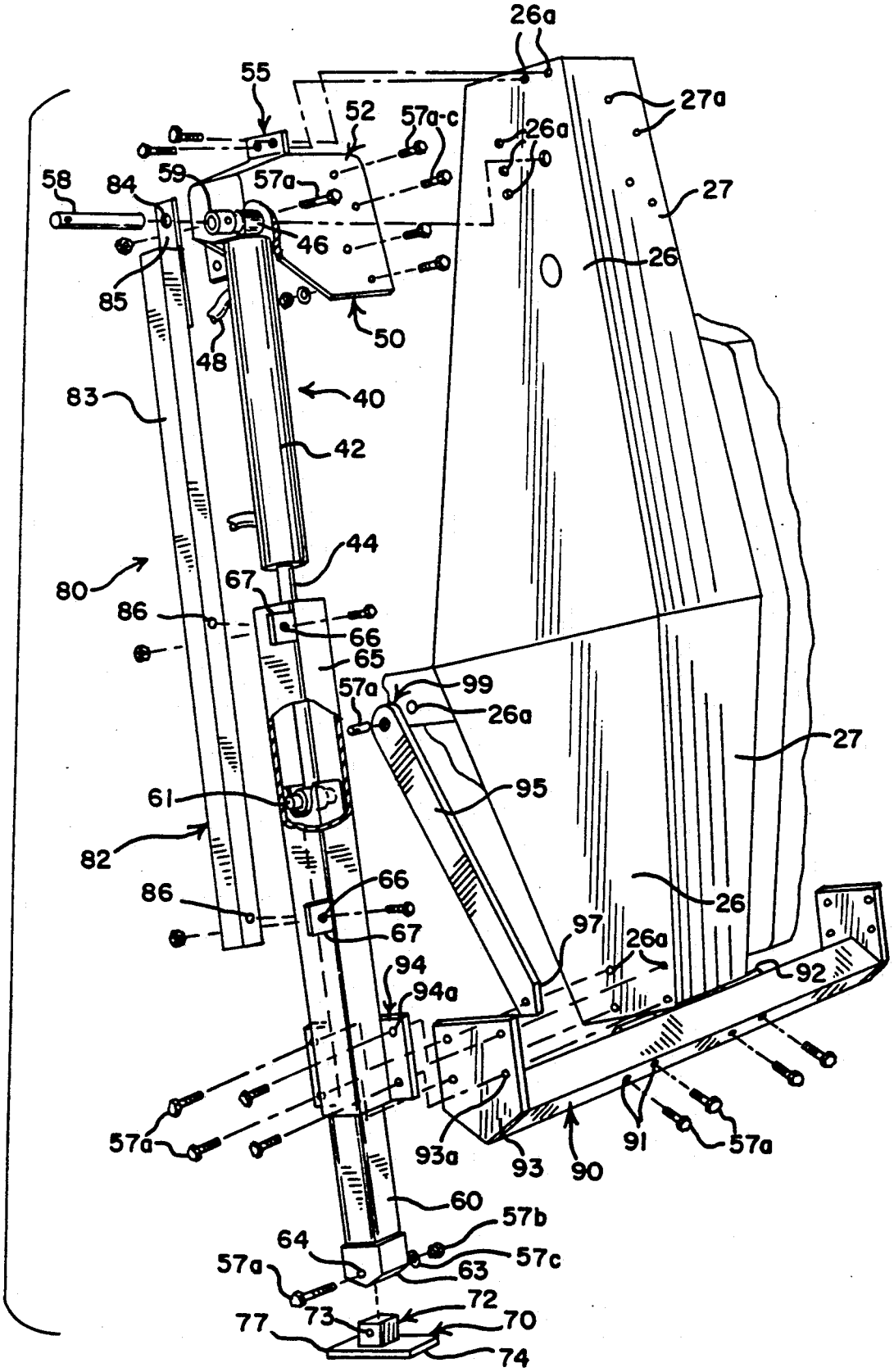
FIG. 3 is a rear exploded view of a stabilizer unit forming one part of a one preferred embodiment of the present invention.

While many types of known utility vehicles may be fitted with the present invention, the invention will be described generally as fitted to one type of such vehicles, commonly known as a "skid steer". This type of utility vehicle is illustrated in FIG. 1 through FIG. 3, and generally designated by reference numeral 20. As with most utility vehicles, vehicle 20 includes a body 22, having a cab 24, longitudinal walls 26, and lateral walls 27, and supported on wheels 28. As illustrated, vehicle 20 has an engine which is rear mounted and covered with an engine cover 29.

One preferred embodiment of a stabilizer system according to the present invention is generally illustrated in FIG. 1 through FIG. 3 by reference numeral 30. System 30 may utilize an individual stabilizer unit 32 mounted on each of the longitudinal walls 26 of the vehicle 20 so that the axis formed by the unit 32 may be in an angular relationship to the wall 26 and to a true vertical. The angle at which the unit 32 is mounted to a true vertical, angle "A", may vary from 0° to 15°. However, the number of stabilizer units 32 used, the wall on which, and the angle at which each unit 32 is mounted will depend on the application to which vehicle 20 is put. The vehicle 20 illustrated in FIG. 1 through FIG. 3 may be used to perform a variety of functions including tree-transplanting work among densly packed trees and on generally non-supportive soils. Given this application, unit 32 is shown as mounted so that the general axis of the unit 32 and a true vertical forms an angle "A" of approximately 10°.

Each stabilizer unit 32 includes hydraulic assembly 40, leg 60, and reinforcing means, such as longitudinal support 82, lateral support 90, and arm 95. The hydraulic assembly 40 will be described first.

The hydraulic assembly 40 may consist of a known arrangement which includes a cylinder 42. Piston 44 slidably moves in and out of the cylinder 42 in response to the flow of fluid driven by a known pump, not shown, supplied through conduits 48 by the hydraulic system of the vehicle 20 or in the alternative by a known separate hydraulic power pack.

Rigidly fixed, as by welding, at an end of the cylinder 42 is bushing 46. Bushing 46 comprises a cylindrical head whose longitudinal axis extends generally perpendicular to the axis of cylinder 42.

The hydraulic assembly 40 must be secured to the body of the vehicle 20 so that the hydraulic assembly 40 may withstand the strain placed on it and without unwanted movement or deflection while the unit 32 is engaged to stabilize the vehicle 20. This may be accomplished, in part, with the use of a housing 50. As the preferred embodiment of the present invention illustrated in FIG. 1 through FIG. 3 shows a stabilizer unit 32 mounted as to extend from each of the longitudinal walls 26 of the vehicle 20, housing 50 includes an attachment cover 52 that extends outwardly from the body of, but within the dimensional profile of the vehicle 20.

Housing 50 may be fixedly secured to the vehicle 20 through any appropriate fixative means. However, since another advantage of the present invention is that it may be quickly attached to and removed from a vehicle 20 with tools commonly available, such appropriate fixative means may include flanges, such as 55, and apertures, such as 57, and a known combination of bolt 57*a*, nut 57*b* and washer 57*c*. Utilizing such fixative means bolt 57*a* may be received through apertures 57 and into appropriate apertures in the longitudinal wall 26, such as apertures 26*a* and into apertures in the lateral wall 27, such as apertures 27*a*.

Hydraulic assembly 40 may be carried within housing 50 by the reception of pin 58 through a housing sleeve formed through a wall of the attachment cover 52 at 59, through the registered bushing 46, and through and into wall 26. Pin 58 may, in fact, be a lengthened version of the pin which partially holds in place and around which the known hydraulic arms of the vehicle 20 pivot. In the illustrated embodiment, pin 58 also holds in place the bucket leveling hydraulic arm of vehicle 20. Pin 58 is held in place by any appropriate means, such as with the above discussed bolt/nut/washer combinations 57*a*–*c*.

Housing 50 is made, as are other the elements of unit 32, from a material, such as a steel alloy, and of a thickness so that housing 50 may accept the forces placed on or transmitted to the hydraulic assembly 40 without resultant deflection or other unwanted movement.

Leg 60 extends groundwardly of hydraulic assembly 40 and is slidably received within leg sleeve 65. Leg 60 may have any cross sectional shape. However, an angular shape, such as a square or a rectangular shape is preferred as such a shaped leg 60 when carried within a similarly shaped sleeve 65 will resist unwanted turning when weight, torque or other stress is placed on leg 60. In comparison, a leg having a circular cross section and carried within a sleeve having a similarly shaped cross section will not resist turning or twisting.

Leg 60 may be rigidly secured to the hydraulic assembly 40 such as with a trapped pin 61 received through the leg at 62 and through a cylindrical end 47 fixed, such as by welding, to piston 44 so that the longitudinal axis of cylindrical end 47 parallels the longitudinal axis of bushing 46 in order to further prevent turning or twisting of the unit 32.

Advantageously, both the leg 60, and, of course, the sleeve 65 are hollow in order to reduce the overall weight of the unit 32. As is the housing 50, leg 60 and sleeve 65 are made from materials, such as a steel alloy, which can withstand the stresses and strains, placed on them without adding greatly to the weight carried by vehicle 20.

Pad 70 includes a generally planar bottom surface 74, the latter of which is appropriately dimensioned to provide the maximum surface area without projecting beyond the dimensional profile of or, when the unit 32 is in the retracted position, largely into the undercarriage clearance space of the vehicle 20. Attached to pad 70, such as by welding, is shank 72. Shank 72 is appropriately shaped and sized to be received within the groundward end of leg 60 and so that when unit 32, and thereby the pad 70 are in the retracted or non-ground engaging position, a rearmost edge 76 of pad 70 will swing upwardly relative to a foremost edge 77 of pad 70. This may be accomplished by the insertion of a bolt, such as bolt 57*a*, through apertures at 64 in the leg 60 and through registered apertures at 73 in shank 72 so that pad 70 may swing freely. In a retracted position, pad 70 may swing to a parallel angular relationship with the angled lower edges 63 of leg 60. This is illustrated in FIG. 1. When pad 70 is extended or lowered to engage the surface of the ground, the bottom surface 74 of pad 70 makes general parallel engaging contact with the surface of the ground.

Advantageously, an operator may retract or extend each leg 60 of each stabilizer unit 32 by the use of suitable known control means, not shown, within the cab 24 of the vehicle 20. Appropriate control means comprise, for example, pedals within the cab through which the fluid flow to the hydraulic assembly 40 may be controlled. By the use of known control means, each stabilizer unit 32 may be individually actuated.

When the system 30 is in operation and the leg 60 of one or both units 32 are in the extended ground-engaging position, unplanned deflection or swaying of each leg 60 and thereby the entire unit 12, may be further minimized, by a variety of elements included within the present invention which further secure and reinforce each unit 32. Such reinforcing elements 80, as illustrated in FIG. 1 through FIG. 3, include a longitudinal support 82, a lateral support 90, and an arm 95.

Longitudinal support 82 may be of many different constructions; however, a preferred and light weight construction includes a hollow tube 83 having a square or rectangular cross-sectional shape. A tube of this shape readily resists turning as discussed above. Also, a hollow tube construction provides the required strength but without the weight of solid construction.

Longitudinal support 82 may be carried generally vertically on the vehicle 20 by the receipt of the pin 58 through an aperture at 84 included in ear 85 which may be affixed to the longitudinal support 82 such as by welding.

To secure leg sleeve 65 by longitudinal support 82, an appropriate means such as bolt 57*a* is received through apertures at 66 in sleeve flanges 67 of sleeve 65 and through apertures at 86 in the longitudinal support 82. Bolt 57*a* may be held in place by any appropriate means such as a nut/washer combination, 57*b*–57*c*. Longitudinal support 82 aids in securing cylinder 42 and the hydraulic assembly 40, the leg 60, and leg sleeve 65 and helps prevent undesirable lateral deflection and other movement or bending of each stabilizer unit 32 particularly perpendicular to the longitudinal wall 26 of the vehicle 20.

The deflection and bending of the stabilizer unit 32 may be prevented further in embodiments of the present invention which are carried on the longitudinal walls 26 of the vehicle 20 by a lateral support 90. In such embodiments, lateral support 90 includes a length of hollow tubular material which may be square or rectangular in cross sectional shape. Lateral support 90 may be secured to the lateral wall 28 of the vehicle 20 by any appropriate means such as by the receipt of bolts, such as bolts 57*a*, held in place with nut/washer combination, such as 57*b*–57*c*, through lateral apertures 91 in the lateral support 90, support plate 92, and into corresponding apertures, not shown, in the lateral wall 27. The lateral support 90 may be affixed to the leg sleeve 65 by any appropriate means such as by, for example, the receipt of bolts, such as bolts 57*a*, into apertures 94*a* in leg flanges 94 fixed to leg sleeve 65, into apertures 93*a* in flanges 93 fixed perpendicularly to the vertical end of lateral support 90, and into apertures in the longitudinal wall 26, such as apertures 26*a*.

Further reinforcement may be added to strengthen each stabilizer unit 32 such as through arm 95. As illustrated in FIG. 1, arm 95 may contact leg sleeve 65 such as at angular edge 97 thereby preventing further forward or backward movement of the sleeve 65. Arm 95 may be affixed to the assembly such as by the receipt of a bolt, such as bolts 57*a*, though apertures at an end 99 of the arm 95 and into an aperture in the longitudinal wall 26, such as aperture 26*a*. The bolts may be held in place such as by a nut/washer combination, such as 57*b*–*c*.

Stabilizer system 30 may be operated as follows. Depending on localized conditions, an operator from within the cab 25 of vehicle 20 using known control means may actuate the hydraulic assembly 40 of each stabilizer unit 32 singly or in some larger number. In response to the fluid flow into cylinder 42 through conduits 48, piston 44 is responsively extended, thereby driving leg 60 from a non-ground engaging position to an extended or ground-engaging position. In this latter position, pad 70 swings so that its bottom surface 74 contacts the surface of the ground. With pad 70 securely in contact with the ground surface, vehicle 20 may be used to perform, even in areas with no more horizontal clearance space around the vehicle 20 than that which an unequipped vehicle 20 may have, the designated task stably and without the danger that the vehicle 20 will sink into the ground or experience other unwanted movement. The reinforcing elements 80 prevent each stabilizer unit 32 from being deflected in any direction in response to the weight and stress placed on the unit 32.

Upon completion of the task, an operator from within the cab 25 of vehicle 20 may retract the leg 60 up and into the leg sleeve 65 of one or all of the stabilizer units 32 which may be attached to vehicle 20. In such a retracted non-ground engaging position, pad 70 is carried outside of the leg sleeve 65 but does not project beyond the dimensional profile of and into the undercarriage clearance space of the vehicle 20. In this position, vehicle 20 may be maneuvered into and around areas providing no more additional undercarriage or wall clearance space than a vehicle unequipped with the present invention may require. As the present invention is fixed to vehicle 20 with conventional means, such as the common bolts/nut/washer combination 57*a*–*c*, the quick attachment and removal of the system and with tools commonly available, is facilitated.

Having thus described the invention, many modifications thereto will become apparent to those skilled in the art to which it pertains without deviating from spirit of the invention as defined by the scope of the appended claims.

What is claimed is:

1. A system for a utility vehicle having generally vertically oriented longitudinal and lateral walls, dimensional profile space, and undercarriage clearance space, said system comprising:

a. a stabilizer unit, said unit mounted in close conformity to the generally vertically oriented walls, said unit comprising:
   (i) a leg, said leg including an angular-shaped straight tube, said leg extending generally groundward and mounted in close conformity to said vertically oriented walls of said vehicle;
   (ii) a sleeve, said sleeve including an angularly shaped hollow tube within which said leg may slidably travel;
   (iii) a pad, said pad connected to a groundward end of said leg and carried exterior to said sleeve, said pad including a ground engaging surface;
   (iv) hydraulic means, said hydraulic means including a fluid actuated piston cylinder, said piston cylinder including a piston having a groundward-oriented end affixed to an end of said leg, said piston cylinder further including a cylinder secured to said vehicle and extending generally external of said sleeve;
   (v) securement means for attaching said stabilizer unit to the vehicle, said securement means including a housing by which one end of said cylinder is secured to said vehicle; and b. means for controlling said stabilizer unit and by which said hydraulic means may be actuated to extend said piston and thereby said leg within the dimensional profile of said vehicle and downwardly until said ground engaging surface of said pad contacts the ground and to retract said piston and thereby said leg upwardly to a non-ground engaging position at which no part of said leg and said pad extend into said undercarriage clearance space.

2. A system according to claim 1, including means for reinforcing said system, said reinforcing means including a longitudinal support secured to said housing and lateral from and parallel to said hydraulic means and said sleeve for preventing deflection and other unwanted movement of said stabilizer unit.

3. A system according to claim 1, further including means for reinforcing said system, said reinforcing means including lateral support means having hollow tubular-shaped walls, one wall of which is secured in close conformity to a lateral wall of said vehicle for preventing deflection and other unwanted movement of said stabilizer unit.

4. A system according to claim 1, further including a means for reinforcing said system, said reinforcing means including an arm, said arm having a forward end secured to said vehicle and a rearward end in engagement with said sleeve for preventing movement of said stabilizer unit.

5. A stabilizer system according to claim 2, wherein said reinforcing means further includes a lateral support, said lateral support being of hollow construction and secured in close conformity to a vertical wall of said vehicle and having an end affixed to said sleeve.

6. A system according to claim 1 wherein said piston cylinder and said leg are aligned along the same general axis.

7. A system according to claim 6 wherein said general axis formed by said piston cylinder and said leg forms an angle to a vertical plane running perpendicular to said walls of said vehicle.

8. A system according to claim 7 wherein said angle is approximately 10°.

9. A system according to claim 6 wherein said axis forms an angle to said generally vertically-oriented longitudinal walls and to said generally vertically-oriented lateral walls of said utility vehicle.

10. A stabilizer apparatus for a utility vehicle having ground-engaging wheels or tracks and a body supported thereby, said vehicle including a dimensional profile whose outer limits are defined by planes that run vertically through points of the vehicle which lie at outermost horizontal locations of the vehicle, said vehicle further including an undercarriage clearance space defined as that space immediately beneath the body of the vehicle and above ground surface, said stabilizer apparatus comprising:

a. a stabilizer unit, said stabilizer unit carried within the dimensional profile of said vehicle and comprising:
   (i) a sleeve, said sleeve fixed to said vehicle within said dimensional profile of said vehicle;
   (ii) a leg, said leg slidably mounted within said sleeve;
   (iii) a pad, said pad carried on a groundward end of said leg and within said dimensional profile of said vehicle;
   (iv) said pad further having a face for engaging ground surface and constructed to facilitate stabilization of said vehicle; and
   (v) a fluid actuated piston cylinder, said piston cylinder including a piston rod, one end of which is attached to said leg, and a cylinder extending generally external of said sleeve and in which said piston rod is linearly movable; and b. control means carried on said vehicle, said control means adapted to actuate said cylinder for retracting said leg and said pad fully above the undercarriage clearance space and within the dimensional profile of said vehicle to permit unobstructed movement of said vehicle and extending said leg and said pad within the dimensional profile of said vehicle until said pad contacts the ground surface for stabilizing said vehicle.

11. A stabilizer apparatus according to claim 10, further including means for reinforcing said apparatus, said means including a longitudinal support having a upper end fixed to a housing secured to a longitudinal wall of said vehicle, within said dimensional profile of said vehicle, and above said undercarriage clearance space, said reinforcing means being for preventing deflection and unwanted movement of said apparatus.

12. A stabilizer apparatus according to claim 10, further including means for reinforcing said stabilizer, said means including a lateral support secured to a lateral wall of said vehicle and said sleeve within the dimensional profile of said vehicle and above said undercarriage clearance space, said reinforcing means being for preventing lateral deflection and unwanted movement of said stabilizer.

13. A stabilizer apparatus according to claim 11 wherein said reinforcing means further includes a lateral support, secured to a lateral wall of said vehicle and to said sleeve within said dimensional profile of said vehicle and above said undercarriage clearance space, which cooperates with said longitudinal support for preventing deflection and unwanted movement of said stabilizer apparatus.

14. A stabilizer apparatus according to claim 10, wherein said stabilizer unit is aligned along an axis, said axis being oriented at an acute angle opening rearward with respect to a true vertical.

15. A stabilizer apparatus according to claim 10 wherein said stabilizer unit is aligned along an axis, said axis being oriented at an acute angle with respect to generally vertical walls of said vehicle.

16. A stabilizer apparatus according to claim 10 wherein said stabilizer unit is aligned along an axis that prarllels generally vertical walls of said vehicle.

17. A utility vehicle for maneuvering into and working stably within areas providing limited clearance space, comprising in combination:

a. a vehicle, said vehicle including wheels or tracks, a body, dimensional profile space defined by farthest generally horizontal points of the vehicle from the body, and undercarriage clearance space between a bottom wall of said vehicle, a ground surface, and said wheels or said tracks; and b. a stabilizer system, said system comprising:
   i. a stabilizer unit carried on said vehicle and within the dimensional profile space of said vehicle, said unit including:
      (i) a leg axially aligned in close conformity to said body of said vehicle;
      (ii) a sleeve axially aligned in close conformity to said body of said vehicle and within which said leg slidably travels;
      (iii) a pad connected to a groundward end of said leg;
      (iv) a fluid actuated piston cylinder, said piston cylinder extending generally external of said sleeve, said piston cylinder having a movable piston linearly associated therewith and to an end of which said leg is fixed;
   ii. a control means by which an operator of the vehicle may actuate and control said stabilizer system, said control means including means for extending said pad to a ground engaging position within the dimensional profile space of said vehicle and fully retracting said pad to a nonground engaging position within the dimensional profile space and above said undercarriage clearance space of said vehicle.

18. A utility vehicle according to claim 17, further including means for reinforcing said stabilizer unit to said vehicle, said reinforcing means including an upper end affixed to a housing projecting laterally from a longitudinal wall of said vehicle and extending parallel to said sleeve within the dimension profile space of said vehicle.

19. A utility vehicle according to claim 17, further including means for reinforcing said stabilizer unit to said vehicle, said reinforcing means including a lateral support having tubular-shaped walls, one wall of which is secured in close conformity to a lateral wall of said body and within the dimensional profile space of said vehicle.

20. A utility vehicle according to claim 18, wherein said reinforcing means include a lateral support having tubular-shaped walls, one wall of which is secured in close conformity to a lateral wall of said body of said vehicle and within the dimensional profile space of said vehicle.

* * * * *